US011815309B2

(12) United States Patent
Turney et al.

(10) Patent No.: US 11,815,309 B2
(45) Date of Patent: Nov. 14, 2023

(54) INTEGRATION OF HYDROGEN LIQUEFACTION WITH GAS PROCESSING UNITS

(71) Applicant: L'Air Liquide, Société Anonyme pour l'Etude et l'Exploitation des Procédés Georges Claude, Paris (FR)

(72) Inventors: Mike Turney, Houston, TX (US); Alain Guillard, Houston, TX (US); Alexander Roesch, Frankfurt (DE)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 621 days.

(21) Appl. No.: 16/183,236

(22) Filed: Nov. 7, 2018

(65) Prior Publication Data

US 2020/0141640 A1 May 7, 2020

(51) Int. Cl.
*F25J 3/06* (2006.01)
*F25J 1/00* (2006.01)

(52) U.S. Cl.
CPC ..... *F25J 3/0655* (2013.01); *F25J 1/001* (2013.01); *F25J 3/061* (2013.01); *F25J 2210/18* (2013.01);
(Continued)

(58) Field of Classification Search
CPC ..... F25J 2210/06; F25J 1/0067; F25J 1/005; F25J 1/0052; F25J 1/0072; F25J 1/0204;
(Continued)

(56) References Cited

U.S. PATENT DOCUMENTS 4,525,185 A * 6/1985 Newton ..... F25J 1/0212 62/612
4,765,813 A 8/1988 Gaumer, Jr. et al.
(Continued)

FOREIGN PATENT DOCUMENTS

CN 1206823 2/1999
EP 2589908 A2 * 5/2013 ..... B01D 53/002
WO WO 2018 091593 5/2018

OTHER PUBLICATIONS

Aziz, M., Production, transportation, and utilization of carbon-free hydrogen, International Conference in Science and Applied Science (ICSAS) 2018, AIP Conf. Proc. 2014, 02001-1-02001-6.

*Primary Examiner* — Ljiljana V. Ciric
(74) *Attorney, Agent, or Firm* — Elwood L. Haynes

(57) ABSTRACT

A method including, compressing a first hydrogen stream, and expanding a portion to produce a hydrogen refrigeration stream, cooling a second hydrogen stream thereby producing a cool hydrogen stream, wherein at least a portion of the refrigeration is provided by a nitrogen refrigeration stream, further cooling at least a portion of the cool hydrogen stream thereby producing a cold hydrogen stream, and a warm hydrogen refrigeration stream wherein at least a portion of the refrigeration is provided by the hydrogen refrigeration stream, compressing the warm hydrogen refrigeration stream, mixing the balance of the compressed first hydrogen stream with a high-pressure gaseous nitrogen stream to form an ammonia synthesis gas stream, and wherein the first hydrogen stream and the warm hydrogen refrigeration stream are compressed in the same compressor.

20 Claims, 12 Drawing Sheets

(52) U.S. Cl.
CPC ..... *F25J 2215/10* (2013.01); *F25J 2270/904* (2013.01)

(58) Field of Classification Search
CPC ..... F25J 1/0205; F25J 1/0221; F25J 1/0234; F25J 1/025; F25J 3/04084; F25J 3/0409; F25J 3/04412; F25J 3/04563; F25J 3/04587; F25J 3/04539; F25J 1/0214; F25J 1/0279; F25J 2230/30; F25J 2245/02; F25J 2210/42; F25J 2230/42; F25J 2270/14; F25J 2260/44; F25J 2215/20; F25J 3/0655; F25J 1/001; F25J 3/061; F25J 2210/18; F25J 2215/10; F25J 2270/904; C01C 1/04
See application file for complete search history.

(56) References Cited

U.S. PATENT DOCUMENTS 5,157,925 A * 10/1992 Denton ..... F25B 9/006 62/612
5,799,505 A 9/1998 Bonaquist et al.
7,082,787 B2 * 8/2006 Lee ..... F25J 3/0219 62/623
9,671,161 B2 * 6/2017 Sicinski ..... F25J 1/0249
11,221,176 B2 * 1/2022 Roberts ..... F25J 1/0022
2005/0210914 A1 9/2005 Allam et al.
2005/0210916 A1 * 9/2005 Prentice ..... F25J 3/04424 62/647
2009/0025422 A1 * 1/2009 Sicinski ..... F25J 1/0022 62/611
2010/0272634 A1 10/2010 Schwartz et al.
2013/0111948 A1 * 5/2013 Higginbotham ..... F25J 3/04563 62/617
2013/0272926 A1 10/2013 Gordon
2014/0053598 A1 2/2014 Ishimaru et al.
2014/0272629 A1 * 9/2014 Berlowitz ..... C21B 15/00 429/411
2014/0366577 A1 * 12/2014 Zubrin ..... C10L 3/10 62/619
2015/0184590 A1 * 7/2015 Conlon ..... F25J 1/0012 60/772
2017/0341942 A1 * 11/2017 Harper, Jr. ..... F01K 7/16
2018/0038638 A1 2/2018 Guillard et al.
2018/0179125 A1 6/2018 Radaelli et al.
2019/0308919 A1 10/2019 Koss et al.

* cited by examiner

INTEGRATION OF HYDROGEN LIQUEFACTION WITH GAS PROCESSING UNITS

BACKGROUND

A major portion of the capital and operating expenditures of a hydrogen liquefaction unit as well as ammonia production unit is from compression equipment. This is typically the hydrogen compression but also includes nitrogen compression.

For an ammonia production unit this compression equipment includes hydrogen compression typically from 20-30 bara (for example from the outlet of a A) to >90 bara for processing with nitrogen in the ammonia production reactor.

The nitrogen gas may be from an air separation unit (ASU) or pipeline.

For a hydrogen liquefier unit, hydrogen compression is typically used to provide feed gas compression as well as refrigeration energy. This is typically in the form of small low-pressure level compression (typically from 1.1 bara inlet to 5-bara outlet), as well as a large high-pressure level compression (typically from 5-10 bara to 50-70 bara). The intermediate pressure level (e.g. typically 5-10 bar) is chosen by process cycle optimization of the refrigeration heat transfer as a trade-off between flow rate and pressure ratio for optimal high-pressure compressor and turbine designs. Many compression and expansion stages are required as hydrogen is difficult to compress and expand due to its very low molecular weight.

It is known that industrial sites often have synergies available making it a desirable location for multiple process units. These synergies are typically the availability of power, cooling water, instrument air, permitting or even a shared source of hydrogen. However, further detailed process synergies are typically not foreseen or feasible due to integration limitations to one or both processes.

It is the object of the present invention to reduce capital and operating cost of an industrial hydrogen liquefaction and ammonia production site.

SUMMARY

A method including, compressing a first hydrogen stream, and expanding a portion to produce a hydrogen refrigeration stream, cooling a second hydrogen stream thereby producing a cool hydrogen stream, wherein at least a portion of the refrigeration is provided by a nitrogen refrigeration stream, further cooling at least a portion of the cool hydrogen stream thereby producing a cold hydrogen stream, and a warm hydrogen refrigeration stream wherein at least a portion of the refrigeration is provided by the hydrogen refrigeration stream, compressing the warm hydrogen refrigeration stream, mixing the balance of the compressed first hydrogen stream with a high-pressure gaseous nitrogen stream to form an ammonia synthesis gas stream, and wherein the first hydrogen stream and the warm hydrogen refrigeration stream are compressed in the same compressor.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
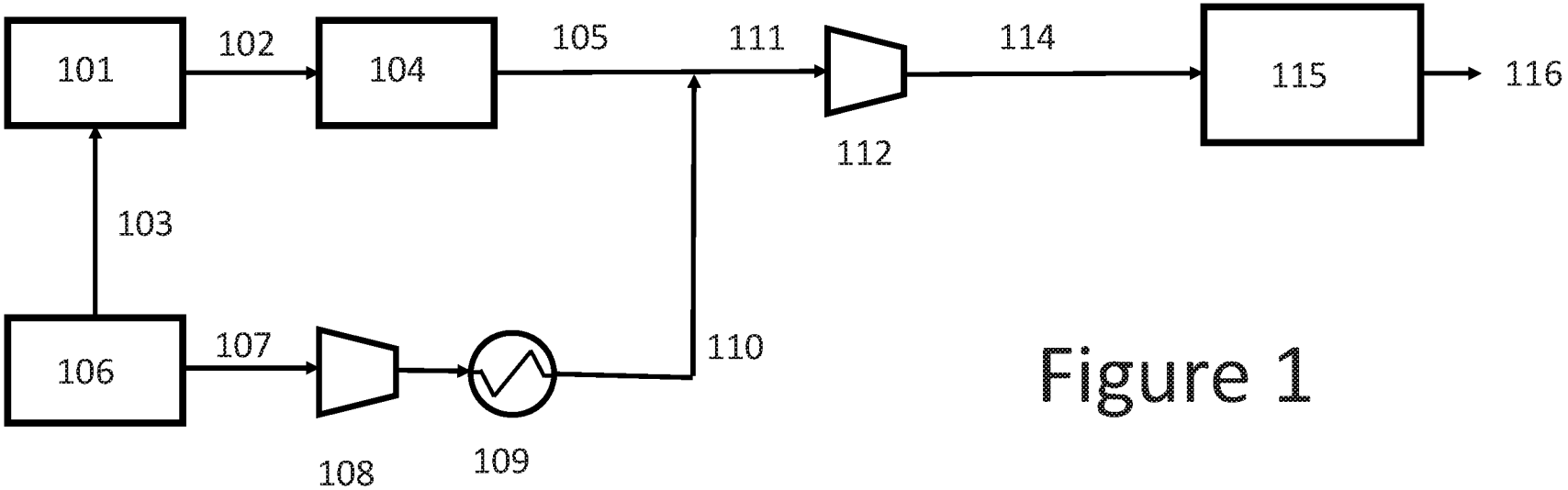
FIG. 1 is a schematic representation a typical ammonia synthesis process cycle, as is known to the art.

Element Numbers 101=hydrogen generation unit
102=synthesis gas stream
103=oxygen stream
104=hydrogen separation device
105=hydrogen inlet stream
106=air separation unit (ASU)
107=gaseous nitrogen stream
108=nitrogen compressor
109=nitrogen cooler
110=high-pressure gaseous nitrogen stream
111=blended reactant gas stream
112=ammonia synthesis gas compressor
114=ammonia synthesis gas stream
115=ammonia reactor
116=product ammonia stream
201=hydrogen liquefaction cold box
201*a*=first cooling zone (in hydrogen liquefaction cold box)
201*b*=second cooling zone (in hydrogen liquefaction cold box)
201*c*=third cooling zone (in hydrogen liquefaction cold box)
202=nitrogen refrigeration cycle

203=secondary refrigeration cycle
204=Joule-Thompson expander
205=expansion turbine
206=flash gas compressor
207=hydrogen recycle compressor
208=product liquefied hydrogen stream
208*a*=gaseous hydrogen stream (within hydrogen liquefaction cold box)
208*b*=cold gaseous hydrogen stream (within hydrogen liquefaction cold box)
208*c*=liquefied hydrogen stream (within hydrogen liquefaction cold box)
209=compressed hydrogen recycle stream
210=first portion (of compressed hydrogen recycle stream)
211=cold, expanded first portion
212=warm hydrogen recycle gas stream
213=second portion (of compressed hydrogen recycle stream)
214=cold, expanded second portion (flash gas stream)
215=warm flash gas stream
216=flash gas cooler
217=compressed and cooled flash gas stream
218=hydrogen recycle cooler
301=first portion (of hydrogen inlet stream)
302=second portion (of hydrogen inlet stream)
303=first fraction (of compressed hydrogen recycle)
304=second portion (of compressed hydrogen recycle)
401=first portion (of hydrogen inlet) stream
402=liquid nitrogen stream (to secondary refrigeration cycle)
403=vaporized nitrogen stream (to secondary refrigeration cycle)
404=compressed nitrogen stream (to secondary refrigeration cycle)
405=nitrogen expander (for secondary refrigeration cycle)
406=expanded nitrogen stream (to secondary refrigeration cycle)
407=combined hydrogen gas stream
408=hydrogen gas compressor
409=hydrogen gas cooler
410=cooled compressed hydrogen gas stream
501=feed air stream (to air separation unit)
502=main air compressor
503=booster/expander
504=main heat exchanger
505=cooled feed air to HP column
506=HP column
507=cooled/expanded air to LP column
508=LP column
509=liquid oxygen stream
510=liquid oxygen stream pump
511=first liquid nitrogen stream
512=first liquid nitrogen stream pump
513=second liquid nitrogen stream
514=second liquid nitrogen stream pump As used herein, the term "hydrogen gas compressor" is defined as a device for pressurizing a gas stream with a nitrogen purity of greater than 99%. This hydrogen gas compressor may be a single compressor or multiple compressors in series or parallel. This hydrogen gas compressor may be of the reciprocal type. This hydrogen gas compressor may be of the centrifugal type. The hydrogen gas compressor may be configured to allow one or more inter-stage injections or withdrawals.

In the present invention, the hydrogen and nitrogen compression requirements of an ammonia (NH3) production unit and hydrogen liquefaction unit are integrated to reduce equipment cost and improve overall system efficiency.

In one embodiment, the hydrogen compression of feed gas to an ammonia unit is combined with the hydrogen recycle refrigeration compression of a hydrogen liquefaction unit. The outlet pressure of one or more refrigeration expansion turbines of the hydrogen liquefier is at or near the pressure of source hydrogen (~20-25 bara). This outlet pressure of one or more refrigeration expansion turbines of the hydrogen liquefier may also be similar to hydrogen liquefaction pressure or the liquefaction pressure may be similar to the outlet of the hydrogen refrigeration compressor. Similarly, the pressure of the high-pressure side of the liquefier refrigerant loop is at or near the pressure of nitrogen mixing. This pressure may be optimized by the limits of brazed aluminum heat exchanger technology, cryogenic hydrogen expander technology, nitrogen source pressure from the air separation unit (ASU) or compressor, and requirements of the ammonia unit.

This enables combining the compression service of hydrogen to the ammonia unit with a hydrogen refrigeration recycle, which has the advantage of reducing equipment cost and improving efficiency. This would be, for example, because a single large compressor is used, rather than two smaller compressors.

Compared to a typical hydrogen liquefaction unit, the result is an increase in operating pressure (from typical 5-10 bara to ~20-25 bara) of the stream between the expansion turbine outlet and the high pressure recycle compressor inlet. This reduces the expansion ratio across the hydrogen compressor and expander(s) resulting in fewer stages and a further cost reduction. The reduced expander pressure ratio means that the flow rate must increase for a similar quantity of refrigeration produced. However, the net flowrate impact is small since the compressor is now combined with hydrogen compression for the ammonia plant.

Although, it is envisioned that the hydrogen compressor maybe a reciprocating type, it is also possible to use other technologies such as centrifugal, which is recently under development for hydrogen compression near these pressures. One skilled in the art will appreciate the importance of lowering the pressure ratio for a centrifugal hydrogen compressor where the low molecular weight yields low pressure ratios per stage thereby reducing the number of compression and expansion stages.

In another embodiment, a single ASU is used to provide the gaseous nitrogen for the ammonia unit as well as N2 (either liquid or high-pressure gas) for refrigeration to the hydrogen liquefier. Optionally, the same ASU may be used to provide oxygen to the partial oxidation reactor (POX) or autothermal reformer (ATR) for generation of the hydrogen.

Optimization of LH2/NH3 Production Ratio

An ASU separates air, which universally contains 78% nitrogen, 21% oxygen and 1% argon, into its component elements. Typically, ASUs are sized based on the demand of one component (either nitrogen or oxygen) while another component is in excess and may therefore be vented to the atmosphere. For example, for a typical ammonia facility, the oxygen demand of the hydrogen generation unit determines the separation capacity of the ASU, while the ammonia reactor uses some, but not all, of the available N2 of the ASU. The excess N2 from the ASU is typically vented to the atmosphere. Therefore, there is a need to optimize the utilization of the available oxygen and nitrogen being produced from the ASU with the demands of the other processes such as hydrogen generation unit, ammonia production and hydrogen liquefaction.

Thus, one skilled in the art will recognize that the quantity of N2 required for the refrigeration purpose of precooling the hydrogen to be liquefied is directly proportional to the liquid hydrogen production flowrate.

It is also recognized that the quantity of high-pressure gaseous N2 required by the ammonia reactor is proportional to the quantity of ammonia production. Similarly, the quantity of oxygen required by the hydrogen generation unit (POX or ATR) is proportional to the quantity of hydrogen required by the ammonia unit in addition to the hydrogen liquefier.

Therefore the total N2 required by the ASU is a function of the combined ammonia plus liquid hydrogen produced [e.g. total ASU N2 demand=f(NH3 product flow, LH2 product flow, site utilities], while the oxygen required from the ASU is a function of the total hydrogen exiting the ammonia and liquefaction units. [i.e. oxygen demand from ASU=f(NH3 product flow, LH2 product flow)]. As a result, the optimum ratio of LH2/NH3 products can be determined based on fully utilizing the available oxygen and nitrogen molecules separated in an ASU preferably without venting (or at least minimizing the venting) one of the separated components.

When liquid N2 is used as the precooling refrigerant for the hydrogen liquefier then the above three functions for 1) oxygen demand, 2) N2 demand, and 3) ASU performance may be used to determine that an optimum LH2/NH3 production ratio is in the range of 0.12-0.15. Similarly, when high pressure gaseous N2 is used as the precooling refrigerant rather than liquid N2, the optimum LH2/NH3 production ratio is in the range of 0.03-0.1 depending on the N2 pressure.

Turning now to FIG. 1, one non-limiting example of an ammonia synthesis process cycle as understood in the state-of-the-art illustrated. Fundamentally, ammonia synthesis requires a hydrogen inlet stream 105 and a high-pressure gaseous nitrogen (N2) stream 110. Typically, these reactant gas streams are blended in what is essentially a stoichiometric ratio. The blended reactant gas stream 111 is then normally compressed 112. The compressed blended reactant gas, or ammonia synthesis gas 114, is then introduced into one or more catalyst beds (not shown) contained within an ammonia reactor 115, thus producing product ammonia stream 116.

Hydrogen inlet stream 105 may be provided by any source, such as a reaction off-gas (not shown) or purposefully produced in a hydrogen generator 101. Such a hydrogen generation system 101 may include, for example, a steam methane reformer, a methane cracker, an autothermal reformer (ATR), or a partial oxidation reformer (POX), or a combination thereof. Hydrogen generation system 101 produces a synthesis gas 102 containing hydrogen and carbon monoxide, usually along with some carbon dioxide and residual hydrocarbons. A hydrogen separation device 104 is then used to produce the hydrogen inlet stream 105 from this syngas stream. Such a hydrogen separation device 104 may be a pressure swing adsorption unit, and/or a membrane separation unit, or other systems known to the art.

The high-pressure gaseous N2 stream 110 may be provided by any source, such as a reaction off-gas (not shown) or purposefully produced in an air separation unit (ASU) 106. There are commonly synergies realized by using an ASU 106 in combination with a hydrogen generation system 101 that requires an oxygen stream 103, such as a POX or ATR. One such synergy would be when the gaseous N2 stream 107, co-produced simultaneously in the ASU 106, is compressed 108, cooled 109, and then blended with the hydrogen 105 produced by the hydrogen generation system 101, and then used in the production of ammonia 116.

Thermodynamically, the reaction of hydrogen inlet stream 105 and high-pressure gaseous nitrogen stream 110 to an ammonia stream 116 requires the reaction to be performed at elevated temperature and pressure. These conditions are usually above 100 bara and at temperatures around 600° C. A hydrogen generation system 101 such as a POX typically operates at a significantly lower pressure, commonly around 30 bara. Likewise, while there are ASU 106 designs that produce high pressure N2 streams, typically the gaseous N2 107 is produced at pressures of approximately 40 bara. So, either individually, or as a combined stream, this reactant stream will need to be compressed 112 prior to entering ammonia reactor 115.

Figure 2:
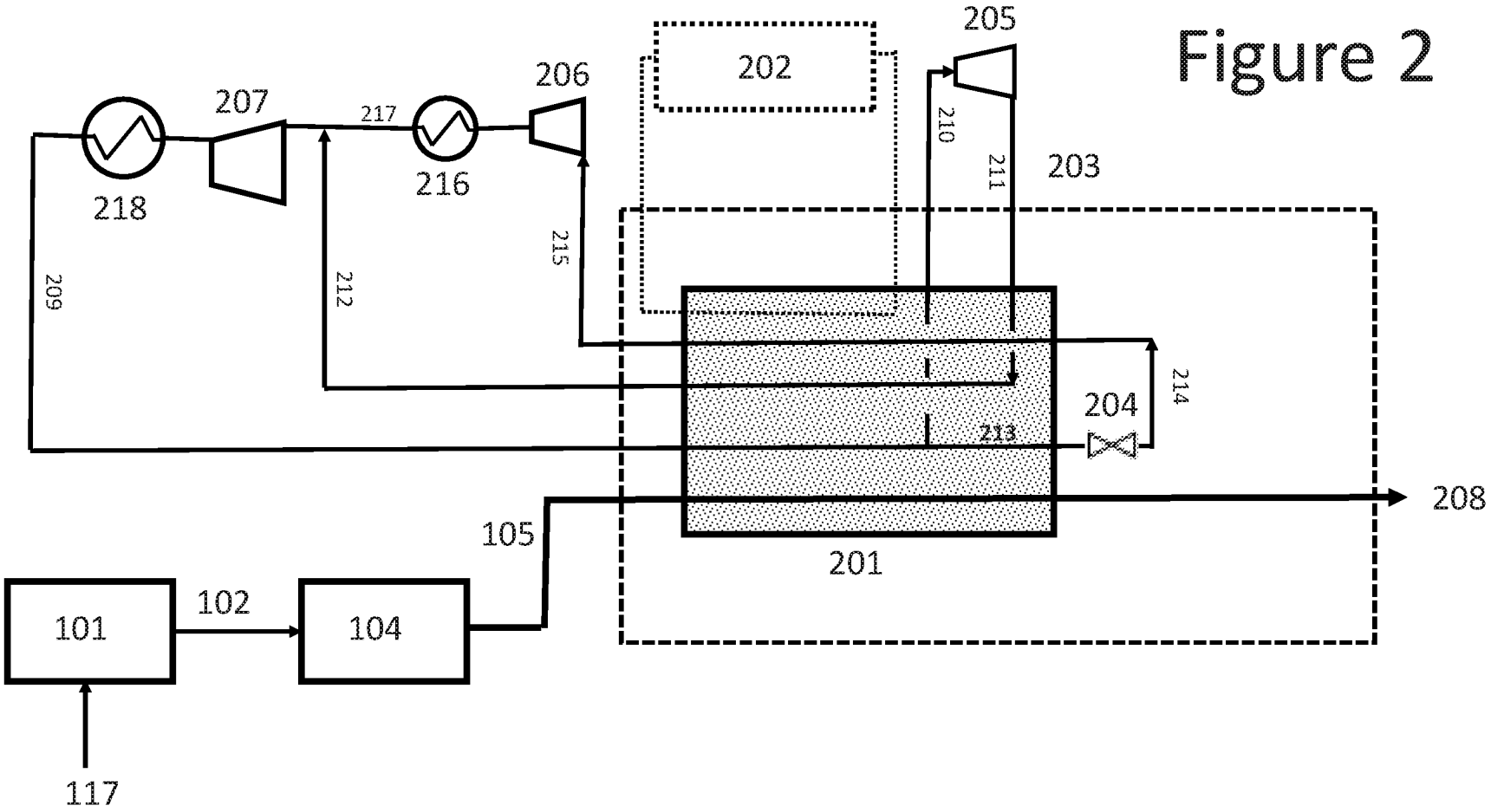
FIG. 2 is a schematic representation of a typical hydrogen liquefaction process cycle, as is known to the art.

Turning to FIG. 2, one non-limiting example of a typical hydrogen liquefaction cycle as understood in the state-of-the-art is illustrated. In a typical hydrogen liquefaction plant, a hydrogen inlet stream 105 is sent to a hydrogen liquefaction cold box 201 where it is initially cooled to approximately −190° C. Often hydrogen inlet stream 105 is at a medium pressure, typically at 20-30 bara. The hydrogen inlet stream 105 may be provided from one or more of the following sources Steam Methane Reformer (SMR), POX, ATR, Pressure Swing Adsorber (PSA) as discussed above as well as other sources such as a byproduct of a Chlor-alkali unit requiring additional compression, reaction off gas, or pipeline.

The hydrogen generation unit 101 is commonly followed by a hydrogen separation device 104 such as a PSA, dryer, etc. However, these warm purification units are limited in their ability to remove of all contaminants which can freeze prior to the liquefaction temperature of hydrogen (~−252 C). The typical outlet of a hydrogen PSA may discharge hydrogen with between 50 to 100 ppm N2, as well as ppm levels of Ar, CO and CH4. These contaminants will freeze, plug, or damage cold end hydrogen liquefaction equipment. It is therefore common within the industry to use a cold adsorption process operating at a temperature of approximately −190 C to remove these impurities to ppb levels. This cold adsorption may be molecular sieve type adsorbent, with regeneration by temperature swings.

In such a system, purified hydrogen, typically having between 1.0% and 0.1% impurities, is further purified by passing through an adsorption bed containing activated carbon (although with safety concerns), silica gel, or molecular sieves at cryogenic temperature.

The use of a cold adsorber on the H2 refrigerant cycle is also known to the art. Any impurities (N2, Ar, etc.) need to be removed from both the H2 being liquefied as well as H2 refrigerant cycle. Theoretically, for a completely closed H2 refrigerant cycle, impurities can be removed only prior to entering the cycle. However, practically, there is an adsorber on the closed hydrogen loop due to makeup flows required for seal losses and any small impurities entering will accumulate overtime.

At least part of the required refrigeration is typically provided by N2 refrigeration 202. The N2 refrigeration 202 may include a single turbine, multiple turbines, and/or turbines with boosters in addition to mechanical refrigeration unit utilizing ammonia, propane, or other refrigerant, vaporization and warming of Liquid N2 (not shown). N2 or other refrigerant (not shown) may be supplied either externally or from nearby ASU. Additionally, the N2 refrigeration 202 may employ a multistage N2 recycle compressor to complete the closed loop (not shown).

The gaseous hydrogen cooled by the nitrogen refrigeration cycle is then typically further cooled and liquefied within the hydrogen liquefaction cold box 201 at approximately −252° C. by a secondary refrigeration cycle 203. Refrigeration for this level of cooling may be provided by an open hydrogen refrigeration cycle, or a closed hydrogen refrigeration cycle with a Joule-Thompson expander, or dense fluid mechanical turbine 204, single or multiple turbines 205, a flash gas compressor 206, and a hydrogen recycle compressor 207. The product liquefied hydrogen stream 208 exits the hydrogen liquefaction cold box 201.

Compressed hydrogen recycle stream 209 enters the hydrogen liquefaction cold box 201. A first portion 210 of compressed hydrogen recycle steam 209 exits hydrogen liquefaction cold box 201 and is expanded in one or more expansion turbines 205. Cold, expanded first portion hydrogen stream 211 then reenters hydrogen liquefaction cold box 201 and indirectly exchanges heat with high purity hydrogen stream 105 and compressed hydrogen recycle stream 209. As the warmed hydrogen recycle gas stream 212 exits the hydrogen liquefaction cold box 201, it is combined with compressed and cooled flash gas 217 (below), compressed in hydrogen recycle compressor 207, cooled 218 and returned to hydrogen liquefaction cold box 201 as compressed hydrogen recycle stream 209.

A second portion 213 of compressed hydrogen recycle stream 209 continues through hydrogen liquefaction cold box 201, after exiting is passed through Joule-Thompson expander or mechanical turbine 204, thus producing a cold, expanded second portion hydrogen stream 214. Cold, expanded second portion hydrogen stream, or flash stream, 214 is then reintroduced into hydrogen liquefaction cold box 201 to indirectly exchange heat with high purity hydrogen stream 105. As the warmed flash gas stream 215 exits the hydrogen liquefaction cold box 201, it is then compressed in a flash gas compressor 206, cooled 216, and combined with the expanded and warmed hydrogen stream 212. This secondary refrigeration cycle typically has a high-side pressure of around 60 bara.

Figure 3:
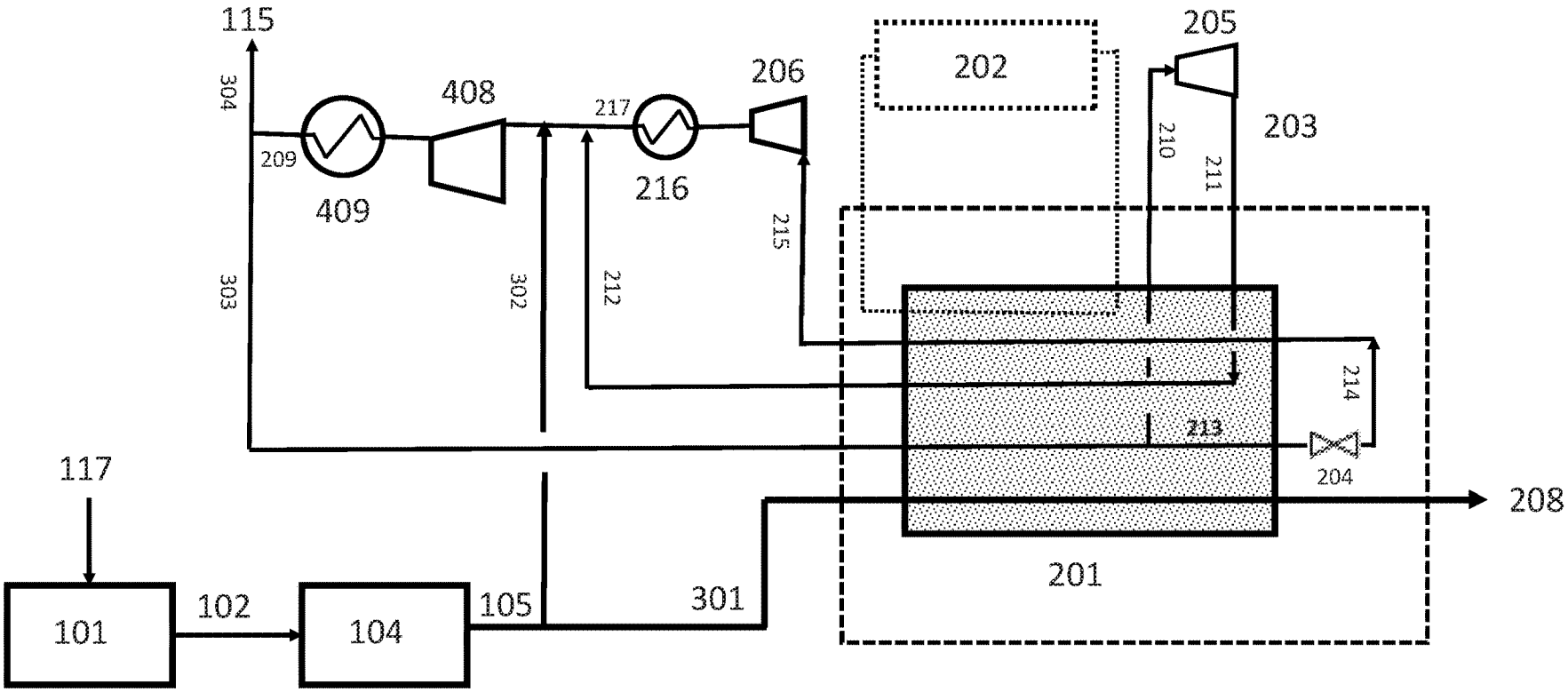
FIG. 3 is a schematic representation of a one embodiment of the present invention.

Turning to FIG. 3, one embodiment of the present invention is illustrated. A hydrogen generation system 101 and separation device 104 may provide a hydrogen inlet stream 105, however hydrogen inlet stream may be provided by other available sources such as a reaction off-gas (not shown). Such a hydrogen generation system 101 may include, for example, a steam methane reformer, a methane cracker, an ATR, or a POX, or a combination thereof. Hydrogen generation system 101 produces a synthesis gas 102 containing hydrogen and carbon monoxide, usually along with some carbon dioxide and residual hydrocarbons. A hydrogen separation device 104 is then used to produce a hydrogen inlet stream 105 from this syngas stream. Such a hydrogen separation device 104 may be a pressure swing adsorption unit, a membrane separation unit, or other systems known to the art.

A first portion 301 of the hydrogen inlet stream 105 is sent to a hydrogen liquefaction cold box 201 where it is initially cooled to approximately −190° C. Often hydrogen inlet stream 105 is at a medium pressure, typically at 20-30 bara. A second portion 302 of the hydrogen inlet stream 105 is sent to blend with the compressed and cooled flash gas stream 217 and warmed hydrogen recycle gas stream 212 (both discussed below).

At least part of the required refrigeration is provided by N2 refrigeration 202. The N2 refrigeration 202 may include a single turbine, multiple turbines, and/or turbines with boosters in addition to mechanical refrigeration unit utilizing ammonia, propane or other refrigerant, vaporization and warming of Liquid (not shown). N2 supplied either externally or from nearby ASU, or other refrigerant (not shown). Additionally, the N2 refrigeration 202 may employ a multistage N2 recycle compressor to complete the closed loop (not shown).

The cooled gaseous hydrogen is then further cooled and liquefied within the hydrogen liquefaction cold box 201 at approximately −252° C. by a secondary refrigeration cycle 203. Refrigeration for this level of cooling may be provided by a hydrogen refrigeration cycle with a Joule-Thompson expander, or dense fluid mechanical turbine 204, single or multiple turbines 205, a flash gas compressor 206, and a hydrogen recycle compressor 408. The product liquefied hydrogen stream 208 exits the hydrogen liquefaction cold box 201.

Figure 4:
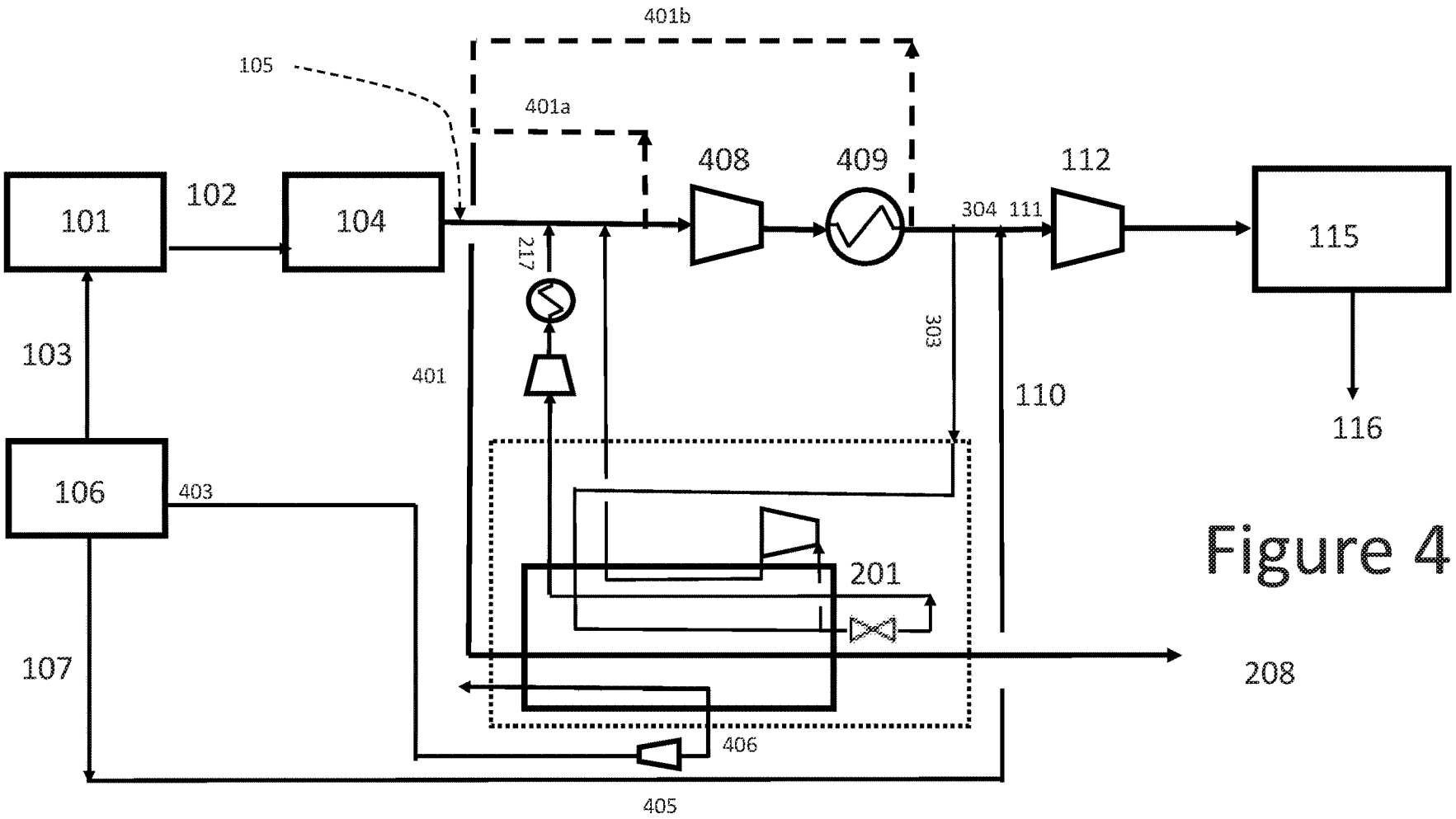
FIG. 4 is a schematic representation a combined hydrogen liquefaction unit and ammonia reactor, with refrigeration for the hydrogen liquefaction produced by expansion of a high-pressure nitrogen stream, in accordance with one embodiment of the present invention.
Figure 6:
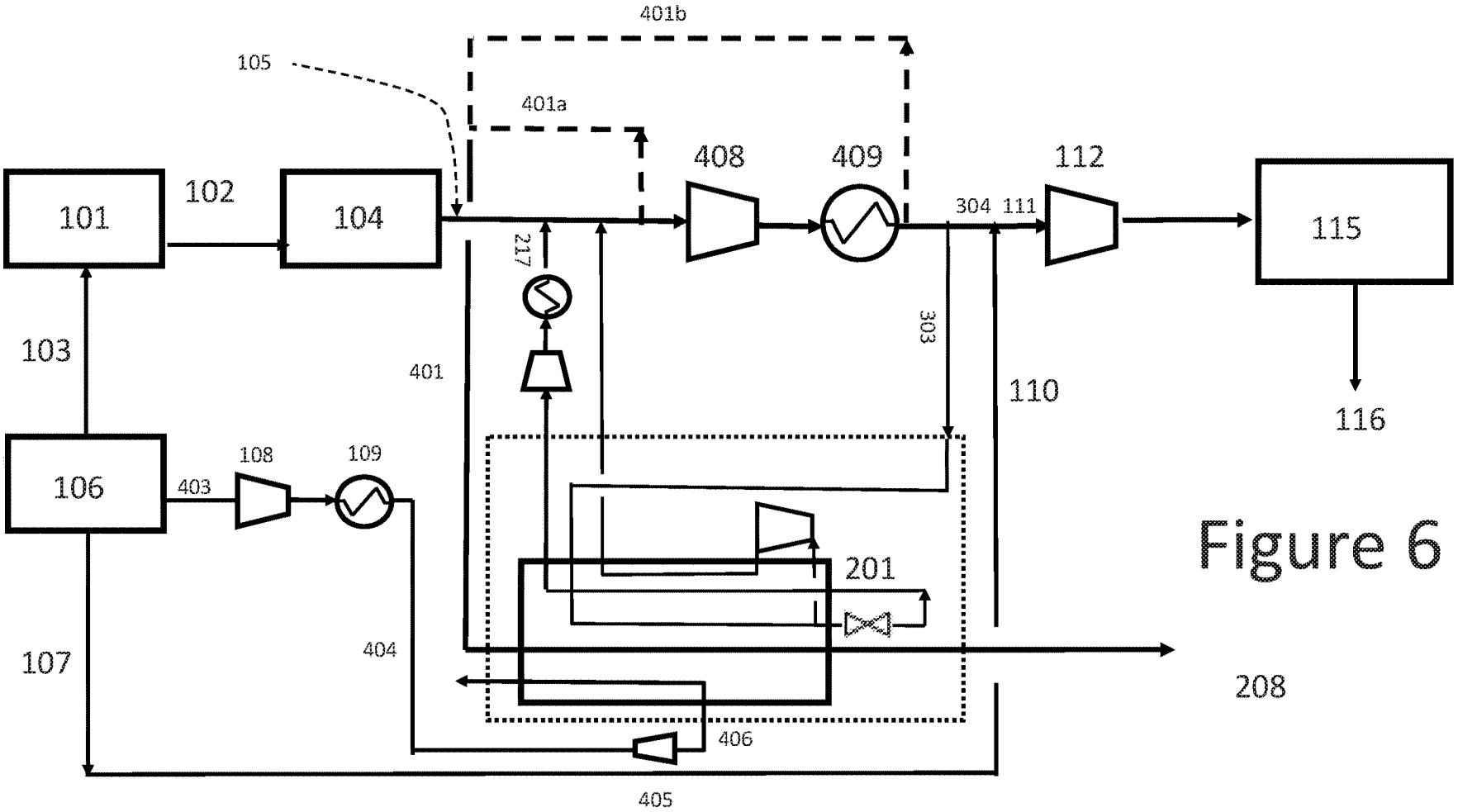
FIG. 6 is a schematic representation a combined hydrogen liquefaction unit and ammonia reactor, with refrigeration for the hydrogen liquefaction produced by compression of medium-pressure nitrogen stream and subsequent expansion, in accordance with one embodiment of the present invention.
Figure 8:
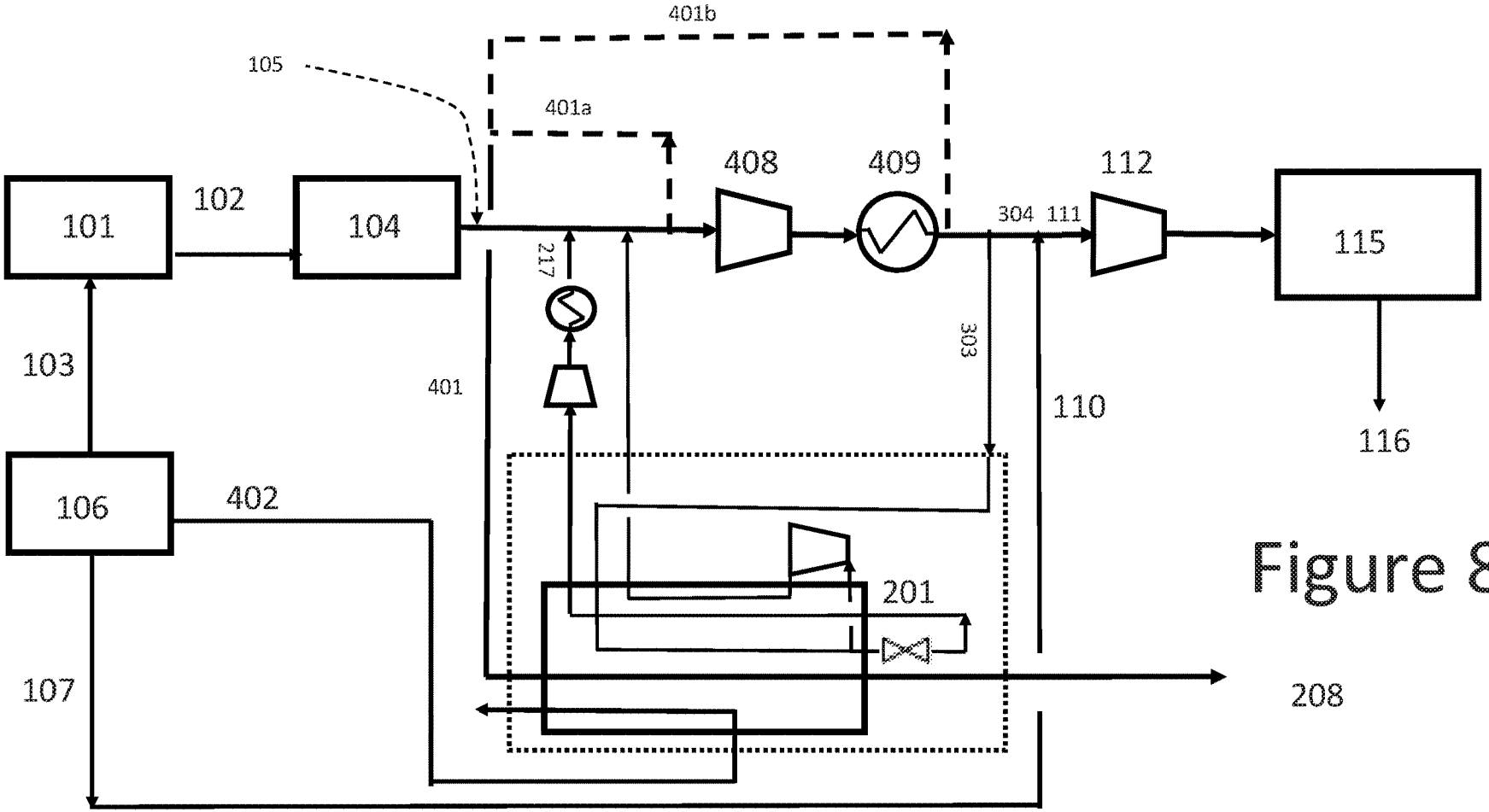
FIG. 8 is a schematic representation a combined hydrogen liquefaction unit and ammonia reactor, with refrigeration for the hydrogen liquefaction produced with a liquid nitrogen stream, in accordance with one embodiment of the present invention.
Figure 12:
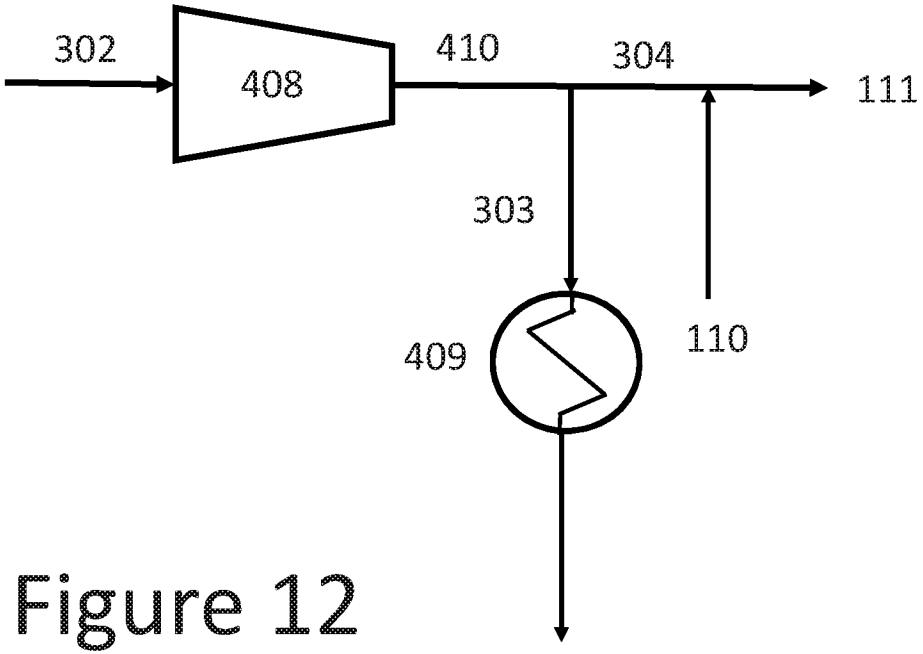
FIG. 12 is a schematic representation of details of the above systems, in accordance with one embodiment of the present invention.

A first fraction 303 of compressed hydrogen recycle stream 209 (discussed below) enters the hydrogen liquefaction cold box 201. First fraction 303 may be withdrawn before hydrogen gas cooler 409 (as shown in FIGS. 4, 6, and 8) or may be withdrawn prior to the hydrogen gas cooler 409 (as shown in FIG. 12). A second fraction 304 of compressed hydrogen recycle stream 209 exits the liquefaction system and may be sent to ammonia reactor 115. A first portion 210 of compressed hydrogen recycle steam 303 exits hydrogen liquefaction cold box 201 and is expanded in one or more expansion turbines 205. Cold, expanded first portion hydrogen stream 211 then reenters hydrogen liquefaction cold box 201 and indirectly exchanges heat with high purity hydrogen streams 301 and 303. As the warmed hydrogen recycle gas stream 212 exits the hydrogen liquefaction cold box 201, it is combined with compressed and cooled flash gas 217 (below) and the second portion 302 of the hydrogen inlet stream 105. This combined stream is then compressed in hydrogen recycle compressor 408 and cooled 409 thereby producing compressed hydrogen recycle stream 209.

A second portion 213 of compressed hydrogen recycle stream 303 continues through hydrogen liquefaction cold box 201, after exiting is passed through Joule-Thompson expander or mechanical dense fluid turbine 204, thus producing a cold, expanded second portion hydrogen stream 214. Cold, expanded second portion hydrogen stream, or flash gas stream, 214 is then reintroduced into hydrogen liquefaction cold box 201 to indirectly exchange heat with high purity hydrogen stream 105. As the warmed flash gas stream 215 exits the hydrogen liquefaction cold box 201, it is then compressed in a flash gas compressor 206, cooled 216, thereby producing compressed and cooled flash gas stream 217. This secondary refrigeration cycle typically has a high-side pressure of around 60 bara.

Turning to FIGS. 4 through 11, additional embodiments of the present invention are illustrated. A hydrogen generation system 101 may provide a hydrogen inlet stream 105, however hydrogen inlet stream may be provided by other available sources such as a reaction off-gas (not shown). Such a hydrogen generation system 101 may include, for example, a steam methane reformer, a methane cracker, an ATR, or a POX, or a combination thereof. Hydrogen generation system 101 produces a synthesis gas 102 containing hydrogen and carbon monoxide, usually along with some carbon dioxide and residual hydrocarbons. A hydrogen separation device 104 is then used to produce hydrogen inlet stream 105 from this syngas stream. Such a hydrogen separation device 104 may be a pressure swing adsorption unit, a membrane separation unit, or other systems known to the art.

The gaseous N2 stream 110 may be provided by any source, such as a reaction off-gas (not shown) or purposefully produced in an ASU 106. There are commonly synergies realized by using an ASU 106 in combination with a hydrogen generation system 101 that requires an oxygen stream 103, such as a POX or ATR. One such synergy would be when liquid N2 is pumped and vaporized within ASU 106, thereby forming high pressure gaseous hydrogen stream 110 (without a gaseous compressor) which is then blended with the hydrogen 105 produced by the hydrogen generation system 101, and then used in the production of ammonia 116.

A first portion 401 of the combined hydrogen gas stream 407 is sent to a hydrogen liquefaction cold box 201 where it is initially cooled to approximately −190° C. At least part of the required refrigeration is provided by N2 refrigerant. Hydrogen stream 401 may be at a medium pressure, typically at 20-30 bara. First portion 401 may be removed from hydrogen inlet stream 105 before (401*a* or 401*b*) or after (401*d*) hydrogen gas compressor 408. First portion 401 may be withdrawn (401*c*) from hydrogen gas compressor 408. A second portion 302 of the combined hydrogen gas stream 407 is combined with compressed and cooled flash gas stream 217 and warmed hydrogen recycle gas stream 212 (both discussed below), thus producing combined hydrogen gas stream 407 which is then sent to hydrogen gas compressor 408.

Figure 5:
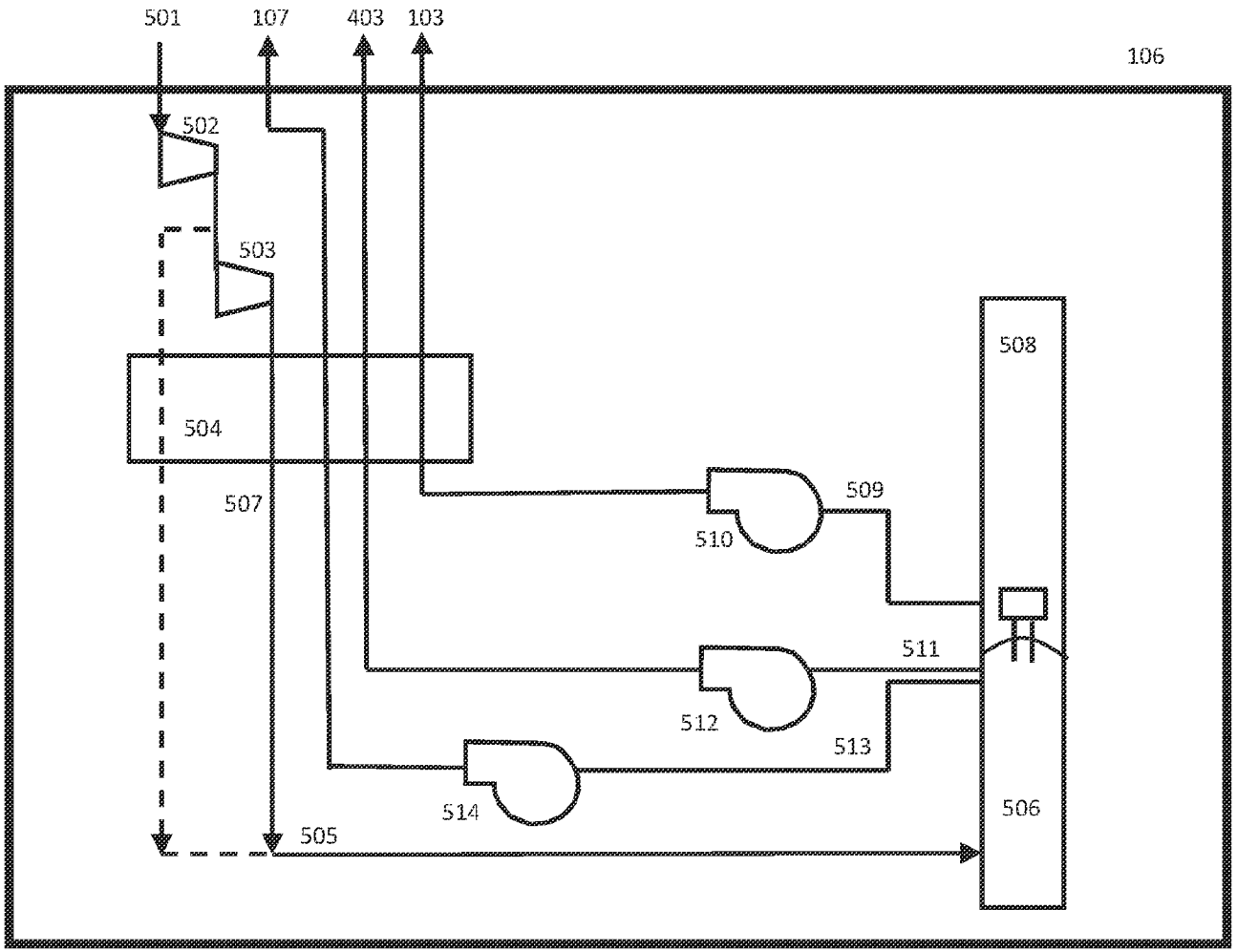
FIG. 5 is a schematic representation an air separation unit compatible with the system in FIG. 4, in accordance with one embodiment of the present invention.

As discussed below in more detail, and as illustrated in FIGS. 4 and 5, N2 refrigerant 403 may be a high-pressure gaseous N2 stream produced within ASU 106 by pumping and vaporizing within the ASU 106. This high pressure gaseous N2 403 stream would be turbo-expanded in the hydrogen liquefaction unit to yield a cold lower pressure gaseous hydrogen refrigerant stream in the hydrogen liquefier.

Figure 7:
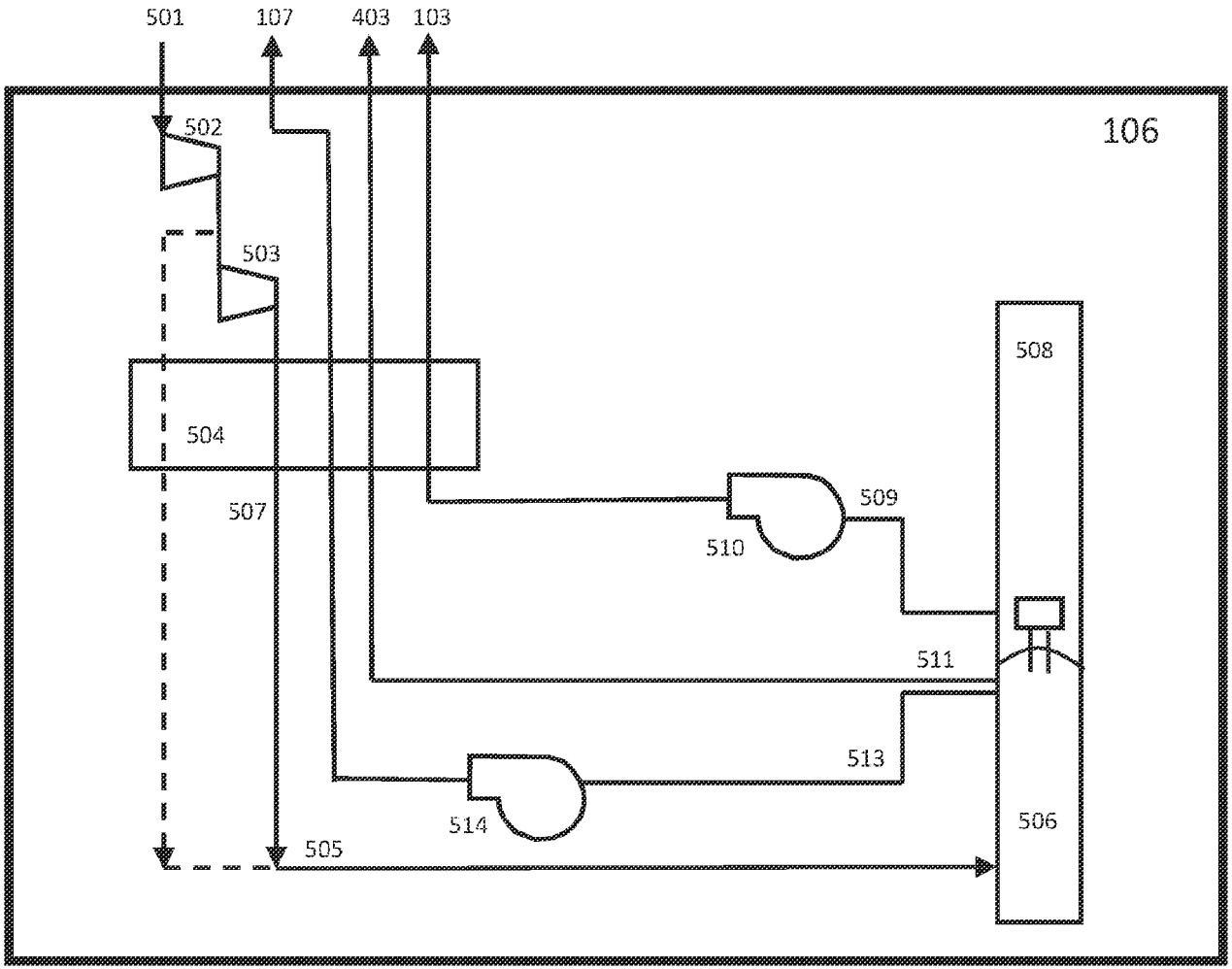
FIG. 7 is a schematic representation an air separation unit compatible with the system in FIG. 6, in accordance with one embodiment of the present invention.

As discussed below in more detail, and as illustrated in FIGS. 6 and 7, N2 refrigerant 403 may also be a medium-pressure gaseous N2 stream produced within ASU 106. This medium-pressure gaseous N2 403 stream would be compressed 108 and cooled 109, thus producing a compressed nitrogen stream 404 that may then be turbo-expanded 405 in the hydrogen liquefaction unit to yield a cold lower pressure gaseous hydrogen refrigerant stream 406 in the hydrogen liquefier.

Figure 9:
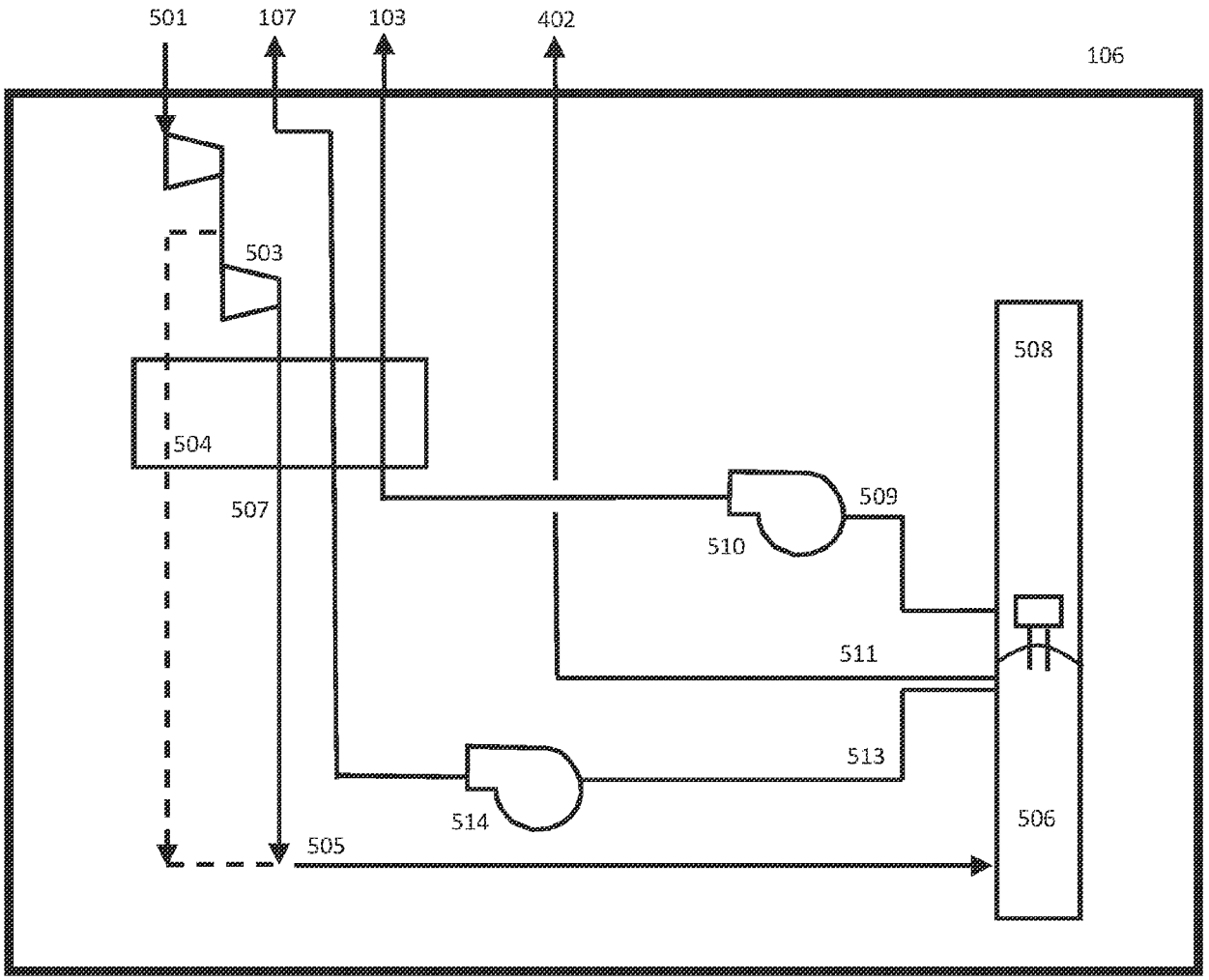
FIG. 9 is a schematic representation an air separation unit compatible with the system in FIG. 8, in accordance with one embodiment of the present invention.

As discussed below in more detail, and as illustrated in FIGS. 8 and 9, N2 refrigerant 402 may also be liquid N2 from ASU 106, such that the liquid N2 is vaporized and heated by heat exchange in the hydrogen liquefaction unit.

As a result of these synergies, N2 refrigeration is provided to the hydrogen liquefaction unit without a gaseous N2 compressor by utilizing the ASU 106 ability to produce either liquid N2 or a high pressure gaseous N2 refrigerant stream. Similarly, the high pressure gaseous N2 stream to the ammonia production unit is provided by pumping and vaporizing in the ASU without a gaseous N2 compressor.

Figure 11:
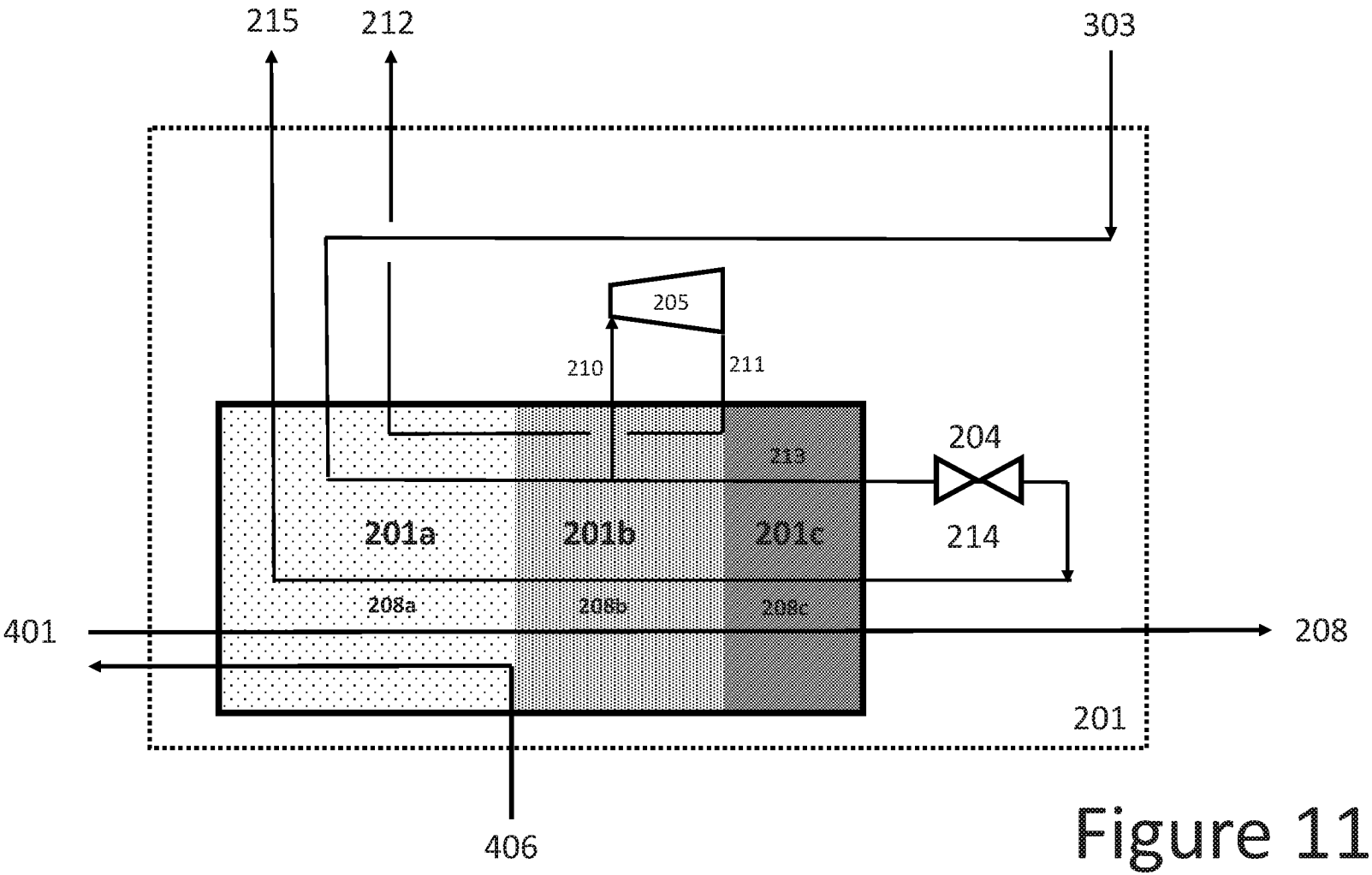
FIG. 11 is a schematic representation of details of the hydrogen liquefaction unit, in accordance with one embodiment of the present invention.

Additional details of the following description may be found in FIG. 11. FIG. 11 is a schematic representation of hydrogen liquefaction cold box 201. Region 201*a* is a symbolic representation of a first cooling zone, predominated by heat exchange with the nitrogen refrigerant. After passing through this first cooling zone, hydrogen stream 208*a* is cold gaseous hydrogen stream 208*b*, which will typically remain fully in the gas phase. Region 201*b* is a symbolic representation of a second cooling zone, predominated by heat exchange with cold, expanded hydrogen first portion exiting expansion turbine 205. After passing through this second cooling zone, hydrogen stream 208*b* may be partially liquefied or cooled supercritical fluid, but will typically not be completely liquefied. Region 201*c* is a symbolic representation of a third cooling zone, predominated by heat exchange with cold, expanded flash gas stream 213 exiting the Joule-Thompson valve or dense fluid turbine 204. After passing through this third cooling zone, hydrogen stream 208*c* will be at least predominantly liquefied and exit as product liquefied hydrogen stream 208.

The hydrogen stream being liquefied 208*a*, 208*b*, 208*c* is typically above its supercritical pressure of 13 bara. Therefore, streams 208*a*, 208*b*, and 208*c* do not exist in either liquid or gaseous state but rather a supercritical state. The supercritical fluid 208 is transferred to liquid as the pressure is letdown below 13 bara to the storage tank.

A first portion 210 of pressurized hydrogen recycle steam 303 exits hydrogen liquefaction cold box 201 and is expanded in expansion turbines 205. First cold, expanded hydrogen stream 211 then reenters hydrogen liquefaction cold box 201 and indirectly exchanges heat with hydrogen stream 208.

Figure 10:
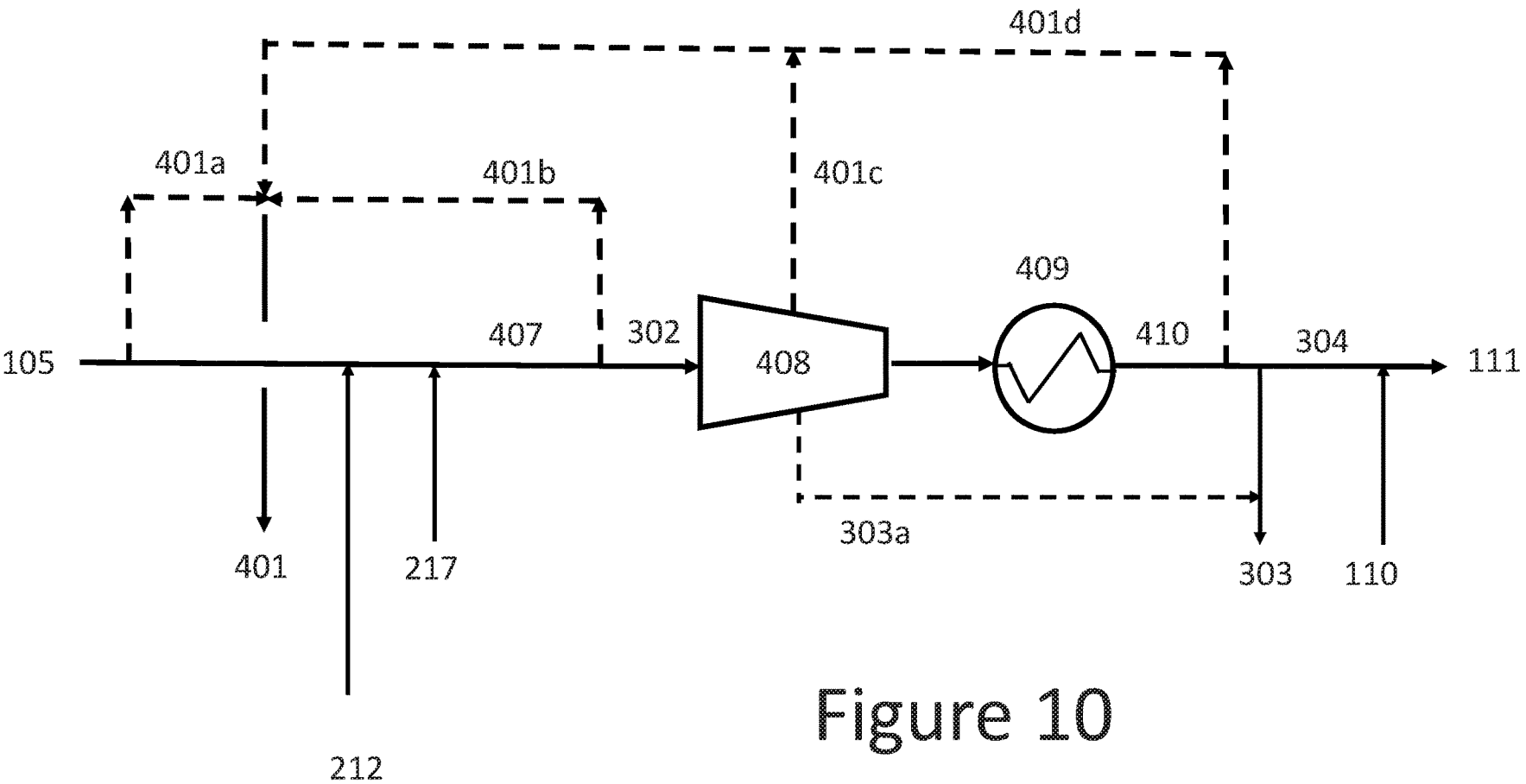
FIG. 10 is a schematic representation of details of the above systems, in accordance with one embodiment of the present invention.

As illustrated in FIG. 10, in one embodiment, as the warmed hydrogen recycle gas stream 212 exits the hydrogen liquefaction cold box 201, it may be combined with compressed and cooled flash gas 217 (below) and the second portion 105. This combined stream 407 is then compressed in hydrogen compressor 408 and cooled 409 thereby producing compressed hydrogen stream 410. In another embodiment, as the warmed hydrogen recycle gas stream 212 exits the hydrogen liquefaction cold box 201, at least a portion 212*a* of stream 212 may be combined directly introduced at an intermediate location into hydrogen compressor 408 and cooled 409.

Also as illustrated in FIG. 10, in one embodiment, as the compressed and cooled flash gas stream 217 exits the hydrogen liquefaction cold box 201, it may be combined with warm hydrogen recycle gas stream 212 and the second portion 302. This combined stream 407 is then compressed in hydrogen compressor 408 and cooled 409 thereby producing compressed hydrogen stream 410.

FIG. 10 also illustrates that pressurized hydrogen recycle steam 303 may be removed from cooled compressed hydrogen gas stream 410 or may be directly removed from hydrogen compressor 408.

As shown in FIGS. 3 through 12, a second portion 213 of compressed hydrogen recycle stream 209 continues through hydrogen liquefaction cold box 201, after exiting is passed through Joule-Thompson expander or mechanical dense fluid turbine 204, thus producing a second cold, expanded hydrogen stream 214. Second cold, expanded hydrogen stream, or flash gas stream, 214 is then reintroduced into hydrogen liquefaction cold box 201 to indirectly exchange heat with high purity hydrogen stream 208. As the warmed flash gas stream 215 exits the hydrogen liquefaction cold box 201, it is then compressed in a flash gas compressor 206, cooled 216, thereby producing compressed and cooled flash gas stream 217. This secondary refrigeration cycle typically has a high-side pressure of around 60 bara.

After exiting compressor 408 and cooler 409, the cooled, compressed hydrogen gas stream 410 is blended with cooled, compressed N2-rich stream 110, thus forming ammonia synthesis gas stream 111. Depending on the pressures of the source streams, ammonia synthesis gas stream 111 may then (optionally) be compressed 112. The compressed ammonia synthesis gas 114, is then introduced into an ammonia reactor 115, thus producing product ammonia stream 116.

As illustrated in FIG. 5, air separation unit 106 may operate in a pumping cycle. In a pumping cycle, cryogenic pumps 510/512/514 are used to pressurize liquid oxygen 509 or liquid nitrogen 511/513, which is then vaporized to produce pressurized gaseous product streams 103/107/403. In this process, the cooling and condensing of at least one high pressure air stream 505 provides the energy to vaporize the pumped oxygen and nitrogen product streams.

The cycle illustrated in FIG. 7, is similar to that illustrated in FIG. 5. The element numbers are identical and the process is identical, so the details of the cycle will not be repeated. The difference is that in FIG. 7, the first nitrogen stream 511 exits the column as a medium pressure gas and thus is not vaporized in the main heat exchanger, but is superheated to near ambient temperature.

The cycle illustrated in FIG. 9, is similar to that illustrated in FIG. 5. The element numbers are identical and the process is identical, so the details of the cycle will not be repeated. The difference is that in FIG. 9, the first nitrogen stream 511 exits the column as a medium pressure liquid and thus is not vaporized in the main heat exchanger, but bypasses it entirely. Nitrogen stream 402 exits air separation unit 106 as a cold intermediate pressure (i.e. 4 bar to 10 bara) liquid stream and may optionally be subcooled.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method comprising:

compressing a first hydrogen stream, and expanding a first portion to produce a hydrogen refrigeration stream, with the remainder forming a second portion cooling a second hydrogen stream against nitrogen refrigeration cycle thereby producing a cool hydrogen stream, wherein at least a portion of the nitrogen refrigeration cycle is provided by a nitrogen refrigeration stream, further cooling at least a portion of the cool hydrogen stream against a secondary refrigeration cycle thereby producing a cold hydrogen stream, and a warm hydrogen refrigeration stream, wherein at least a portion of the secondary refrigeration cycle is provided by the hydrogen refrigeration stream, compressing the warm hydrogen refrigeration stream, mixing the second portion with a high-pressure gaseous nitrogen stream to form an ammonia synthesis gas stream, and wherein the first hydrogen stream and the warm hydrogen refrigeration stream are compressed in the same compressor.

2. The method of claim 1, wherein the first portion is removed downstream of the compressor.

3. The method of claim 1, wherein the portion of the first hydrogen stream is withdrawn between compression stages of the compressor.

4. The method of claim 1, wherein the second portion is removed upstream of the compressor.

5. The method of claim 1, wherein the second hydrogen stream is withdrawn between compression stages of the compressor.

6. The method of claim 1, wherein the second portion is removed downstream of the compressor.

7. The method of claim 1, wherein the first portion and the second portion are derived from a syngas stream produced in a hydrogen generator.

8. The method of claim 7, wherein the hydrogen generator comprises a partial oxidation reactor or an autothermal reformer.

9. The method of claim 8, wherein the first hydrogen stream and the second hydrogen stream are separated from the syngas stream by at least one pressure swing adsorption unit.

10. The method of claim 7, wherein the nitrogen refrigeration stream is produced by the vaporization of a liquid nitrogen stream within an Air Separation Unit.

11. The method of claim 10, wherein the high-pressure gaseous nitrogen stream is produced by pumping and vaporizing a liquid nitrogen stream within the air separation unit, and wherein no nitrogen compressor is required.

12. The method of claim 11, wherein an oxygen-containing stream is provided to the hydrogen generator, wherein both the nitrogen refrigeration stream and the high-pressure nitrogen stream are produced within the same air separation unit that produced the oxygen-containing stream, and wherein the mass ratio of liquid hydrogen produced to ammonia produced is less than 0.1.

13. The method of claim 7, wherein the nitrogen refrigeration stream is a gaseous nitrogen stream produced within an air separation unit.

14. The method of claim 13, wherein the nitrogen refrigeration stream is compressed downstream of the air separation unit.

15. The method of claim 13, wherein the high-pressure gaseous nitrogen stream is produced by pumping and vaporizing a liquid nitrogen stream within the air separation unit, and wherein no nitrogen compressor is required.

16. The method of claim 15, wherein an oxygen-containing stream is provided to the hydrogen generator, wherein both the nitrogen refrigeration stream and the high-pressure nitrogen stream are produced within the same air separation unit that produced the oxygen-containing stream, and wherein the mass ratio of liquid hydrogen produced to ammonia produced is less than 0.1, preferably less than 0.05.

17. The method of claim 7, wherein the nitrogen refrigeration stream is a liquid nitrogen stream.

18. The method of claim 17, wherein the high-pressure gaseous nitrogen stream is produced by pumping and vaporizing a liquid nitrogen stream within an air separation unit, and wherein no nitrogen compressor is required.

19. The method of claim 18, wherein an oxygen-containing stream is provided to the hydrogen generator, wherein both the nitrogen refrigeration stream and the high-pressure nitrogen stream are produced within the same air separation unit that produced the oxygen-containing stream, and wherein the mass ratio of liquid hydrogen produced to ammonia produced is less than 0.2, preferably less than 0.15.

20. The method of claim 1, wherein the ammonia synthesis gas stream is further compressed and cooled prior to being introduced into the ammonia production unit.

* * * * *